US006759793B2

(12) United States Patent
Narita

(10) Patent No.: US 6,759,793 B2
(45) Date of Patent: Jul. 6, 2004

(54) LAMP UNIT FOR A PROJECTOR AND A PROCESS FOR THE LIGHT CONTROL THEREOF

(75) Inventor: Mituo Narita, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,537

(22) Filed: Jul. 27, 2001

(65) Prior Publication Data

US 2002/0017842 A1 Feb. 14, 2002

(30) Foreign Application Priority Data

Aug. 4, 2000 (JP) ..... 2000-236621

(51) Int. Cl.[7] ..... H01J 1/02; F21V 29/00
(52) U.S. Cl. ..... 313/13; 362/264; 362/294
(58) Field of Search ..... 313/13, 113, 11, 313/24, 634, 639, 46, 47; 362/294, 345, 373, 263, 264, 265

(56) References Cited

U.S. PATENT DOCUMENTS

| | | | | |
|---|---|---|---|---|
| 4,168,522 A | | 9/1979 | van de Laarschot et al. | 362/294 |
| 4,283,658 A | * | 8/1981 | Parker | 315/117 |
| 4,518,895 A | * | 5/1985 | Lehman | 315/117 |
| 4,533,854 A | | 8/1985 | Northup | 315/117 |
| 4,630,182 A | * | 12/1986 | Moroi et al. | 362/294 |
| 4,672,271 A | | 6/1987 | Gear et al. | 315/117 |
| 5,109,181 A | | 4/1992 | Fischer et al. | |
| 5,207,505 A | * | 5/1993 | Naraki et al. | 362/373 |
| 5,497,049 A | | 3/1996 | Fischer | |
| 5,957,570 A | * | 9/1999 | Ooyama et al. | 362/263 |
| 6,274,983 B1 | * | 8/2001 | Ooyama et al. | 313/632 |
| 6,498,423 B1 | * | 12/2002 | Bell et al. | 313/24 |
| 2001/0010447 A1 | * | 8/2001 | Yamane et al. | 313/113 |

FOREIGN PATENT DOCUMENTS

| | | | |
|---|---|---|---|
| GB | 2 052 811 | 1/1981 | G05D/25/02 |
| GB | 2 220 297 | 1/1990 | H01J/61/24 |
| JP | 63-131460 | 6/1988 | H01J/61/52 |
| JP | 03-112046 | 5/1991 | H01J/61/52 |
| JP | 08-022075 | 1/1996 | G03B/21/16 |
| JP | 09-147805 | 6/1997 | H01J/61/62 |
| JP | 11-195322 | 7/1999 | F21V/29/00 |
| JP | 11-329015 | 11/1999 | F21M/7/00 |

* cited by examiner

*Primary Examiner*—Thomas M. Sember
*Assistant Examiner*—Peter Macchiarolo
(74) *Attorney, Agent, or Firm*—Nixon Peabody LLP; David S. Safran

(57) ABSTRACT

A lamp unit with a light control function for the light emitted from this lamp unit, for which a high pressure mercury lamp is used which is filled with at least 0.15 mg/mm$^3$ mercury and which has a hermetically enclosing arrangement, an essentially hermetically enclosing arrangement or an arrangement in which there is a flow path for actively flowing cooling air within. The lamp unit for a projector has a high pressure mercury lamp of the short arc type with a wall load of at least 1 W/mm$^2$ which is filled with at least 0.15 mg/mm$^3$ mercury, a concave reflector which surrounds this mercury lamp, a front cover which covers the front opening of this concave reflector, a cooling arrangement which can be controlled with respect to its cooling intensity for cooling of the concave reflector and/or the mercury lamp and a control device by which the power of the mercury lamp can be changed, the cooling and the control device being made such that, by controlling the two, a value in the range of $1<(W\times G/V)$ can be set, where V (in cm$^3$) is the inside volume of the concave reflector, W (in W) is the rated power of the mercury lamp and G (in W/mm$^2$) is the wall load. Furthermore, a process for light controlling such a lamp unit is given.

11 Claims, 4 Drawing Sheets

FIG. 5(a)

TEST 1

| Lamp power W | Wall load G | K | Arrangement | 1st Evaluation | 2nd Evaluation | 3rd Evaluation | 4th Evaluation | Rating |
|---|---|---|---|---|---|---|---|---|
| 100 | 0.83 | 0.64 | Hermetic enclosure | X | - | - | - | X |
| 120 | 1.00 | 0.92 | Hermetic enclosure | X | - | - | - | X |
| 130 | 1.08 | 1.08 | Hermetic enclosure | O | O | O | O | O |
| 150 | 1.25 | 1.44 | Hermetic enclosure | O | O | O | O | O |
| 160 | 1.33 | 1.64 | Hermetic enclosure | O | O | O | O | O |
| 170 | 1.42 | 1.85 | Hermetic enclosure | O | O | O | O | O |
| 180 | 1.50 | 2.08 | Hermetic enclosure | O | X | - | X | X |
| 200 | 1.67 | 2.56 | Hermetic enclosure | O | X | - | X | X |
| 100 | 0.83 | 0.64 | opening | X | - | - | - | X |
| 120 | 1.00 | 0.92 | opening | X | - | - | - | X |
| 130 | 1.08 | 1.08 | opening | O | O | O | O | O |
| 150 | 1.25 | 1.44 | opening | O | O | O | O | O |
| 160 | 1.33 | 1.64 | opening | O | O | O | O | O |
| 170 | 1.42 | 1.85 | opening | O | O | O | O | O |
| 180 | 1.50 | 2.08 | opening | O | X | - | X | X |
| 200 | 1.67 | 2.56 | opening | O | X | - | X | X |
| 120 | 1.00 | 0.92 | Differential pressure | X | - | - | - | X |
| 130 | 1.08 | 1.08 | Differential pressure | O | O | O | O | O |
| 150 | 1.25 | 1.44 | Differential pressure | O | O | O | O | O |
| 160 | 1.33 | 1.64 | Differential pressure | O | O | O | O | O |
| 170 | 1.42 | 1.85 | Differential pressure | O | O | O | O | O |
| 180 | 1.50 | 2.08 | Differential pressure | O | O | O | O | O |
| 200 | 1.67 | 2.56 | Differential pressure | O | O | O | O | O |

FIG. 5(b)

Test 2

| Lamp power W | Wall load G | K | Arrangement | 1st Evaluation | 2nd Evaluation | 3rd Evaluation | 4th Evaluation | Rating |
|---|---|---|---|---|---|---|---|---|
| 80 | 0.67 | 0.67 | Hermetic enclosure | X | - | - | - | X |
| 90 | 0.75 | 0.84 | Hermetic enclosure | X | - | - | - | X |
| 100 | 0.83 | 1.04 | Hermetic enclosure | O | O | O | O | O |
| 130 | 1.08 | 1.76 | Hermetic enclosure | O | O | O | O | O |
| 140 | 1.17 | 2.04 | Hermetic enclosure | O | X | X | X | X |
| 90 | 0.75 | 0.84 | opening | X | - | - | - | X |
| 100 | 0.83 | 1.04 | opening | O | O | O | O | O |
| 130 | 1.08 | 1.76 | opening | O | O | O | O | O |
| 140 | 1.17 | 2.04 | opening | O | X | X | X | X |
| 150 | 1.25 | 2.34 | opening | O | X | X | X | X |
| 90 | 0.75 | 0.84 | Differential pressure | X | - | - | - | X |
| 100 | 0.83 | 1.04 | Differential pressure | O | O | O | O | O |
| 130 | 1.08 | 1.76 | Differential pressure | O | O | O | O | O |
| 140 | 1.17 | 2.04 | Differential pressure | O | O | O | O | O |
| 150 | 1.25 | 2.34 | Differential pressure | O | O | O | O | O |
| 200 | 1.67 | 4.17 | Differential pressure | O | O | O | O | O |

LAMP UNIT FOR A PROJECTOR AND A PROCESS FOR THE LIGHT CONTROL THEREOF

BACKGROUND OF THE INVENTION

1. Field of the Invention

The invention relates to a lamp unit in which a high pressure mercury lamp is located, and a process for light control thereof. The invention relates especially to a lamp unit for a projector which is used as a light source of a liquid crystal projector, a DLP (digital light processor) or the like, and a process for light control thereof.

2. Description of Related Art

In a projector device of the projection type, there is a need for illumination of images onto a rectangular screen in a uniform manner and with sufficient color reproduction. The light source is therefore a metal halide lamp which is filled with mercury and a metal halide. Furthermore, smaller and smaller metal halide lamps have been used recently, and more and more often point light sources are being produced, and lamps with extremely small distances between the electrodes are being used in practice.

Against this background, lamps with an unprecedentedly high mercury vapor pressure, for example, with pressures of 200 bar (roughly 197 atm) or more have been recently proposed instead of metal halide lamps. Here, due to the increased mercury vapor pressure, broadening of the arc is suppressed (the arc is contracted) and an extensive increase of the light intensity is desired; this is disclosed, for example, in U.S. Pat. No. 5,109,181 and in U.S. Pat. No. 5,497,049.

A lamp unit which is to be used for a projector comprises the above described mercury lamp, a concave reflector which surrounds it, and a front glass for the concave reflector. The arrangement of the front glass imparts a hermetically enclosing arrangement to the interior of the concave reflector. Alternatively, the interior of the concave reflector acquires an essentially hermetically enclosing arrangement, even if part is provided with a cooling opening. This hermetically enclosing arrangement in the above described lamp, which has been filled with a large amount of mercury, makes it possible for mercury to vaporize enough by, during lamp operation, the temperature being increased without being cooled by outside air. Thus, it no longer becomes necessary to have a special preheating device or the like which is used for complete vaporization of the mercury. Furthermore, it is possible to eliminate the defect that glass fragments and the like will spray out from the unit when, in the worst case, the lamp is damaged or the like.

On the other hand, in a projector device, there is the need for a light control function to control the screen illuminance according to the environment and the image projection situation. To meet this need, the light emitted from the lamp unit can be subjected to light control using a radiation attenuation means. With consideration of the need to reduce the size of the projector device, however, control of the intensity of the radiant light from the lamp unit, in and of itself, is required as a process for the above described light control in the inherent sense. Here, for example, in a bright room or for a large screen, by increasing the starting power for the lamp, its radiation intensity is increased while, in a relatively dark room or for a small screen, the starting power for the lamp is reduced.

However, since the above described lamp unit is built with a hermetically enclosing arrangement, with consideration of the nominal wattage of the lamp in steady-state luminous operation and of the inside volume of the interior of the unit in the vicinity, the range in which the starting power for the lamp can be changed is extremely narrowly restricted. Specifically, if the starting power for the lamp is unduly reduced to reduce the radiation intensity, a phenomenon is caused which is called "nonvaporization of the mercury in the lamp". This engenders the problem that the desired emission spectrum characteristic is not obtained. On the other hand, the temperature within the unit is extremely high when the starting power for the lamp is unduly increased to increase the radiation intensity. This can engender the problems that the electrodes and the like in the lamp are used up, that the film which has been deposited on the inside of the concave reflector is degenerated and that the lamp is damaged (broken).

The above described prior art is summarized below.

First, with respect to the light source of a projector device the following is desired:

With respect to the characteristic, a mercury lamp filled with a large amount of mercury, for example, a lamp with at least 0.15 mg/mm$^3$, is desired. In a lamp unit using this lamp, with consideration of the reduction in size and the safety of the projector device, a hermetically enclosing arrangement or an arrangement which is only partly provided with cooling openings is desired.

Second, for a projector device, there is a great demand for a light control function as a lamp unit to adequately satisfy the many application purposes of the user of this device.

SUMMARY OF THE INVENTION

The invention was devised to yield a lamp unit for a projector which can adequately meet the aforementioned requirements.

A primary object of the present invention is to devise a lamp unit with a light control function for the light emitted from this lamp unit, for which a high pressure mercury lamp is used which is filled with at least 0.15 mg/mm$^3$ mercury and which lamp unit has a hermetically enclosing arrangement, an essentially hermetically enclosing arrangement or an arrangement in which a flow path for actively flowing cooling air is formed.

The above object is achieved, in its widest aspect, for a lamp unit in which it comprises:

- a high pressure mercury lamp of the short arc type with a wall load of at least 1 W/mm$^2$ which is filled with at least 0.15 mg/mm$^3$ mercury;
- a concave reflector which surrounds this mercury lamp; and
- a front cover which covers the front opening of this concave reflector,
- a cooling means which can be controlled with respect to its cooling intensity for cooling of the concave reflector and/or the mercury lamp and
- a means by which the radiant power of the mercury lamp can be changed, the cooling means and the means for controlling the lamp power being made such that, by controlling the two, a value in the range of $1<(W\times G/V)$ can be set, V (in cm$^3$) being the inside volume of the concave reflector, W (in W) being the rated power of the mercury lamp and G (in W/mm$^2$) being the wall load.

The suggested approach can be used both for hermetically enclosing and essentially hermetically enclosing arrangements of lamp units or also for those lamp units which are cooled forcefully by controlled feed of cooling air. For these different types of lamp units preferred ranges (W×G/V) were determined; this is to be explained in detail below.

The object was achieved in accordance with the invention in a lamp unit with a hermetically enclosing arrangement or an essentially hermetically enclosing arrangement which comprises:

- a high pressure mercury lamp of the short arc type with a wall load of at least equal to 1 $W/mm^2$ which is filled with at least 0.15 $mg/mm^3$ mercury;
- a concave reflector which surrounds this mercury lamp; and
- a front cover (also called the front glass) which covers the front opening of this concave reflector,
- in which, in the range $1<(W\times G/V)<2$, in conjunction with the cooling intensity of a cooling means with an intensity which can be changed with respect to the above described concave reflector and/or the above described mercury lamp, there is a means which changes the power of the mercury lamp, and thus, light control of the above described mercury lamp is enabled, where V ($cm^3$) is the inside volume of the concave reflector, W is the rated power of the mercury lamp and G is the wall load.

Furthermore, in accordance with the invention, a process for light control of such a lamp unit is given.

The object is furthermore achieved in accordance with the invention in that the above described lamp unit has neither a hermetically enclosing arrangement nor an essentially hermetically enclosing arrangement, but an arrangement in which a flow path for active flow of the cooling air is formed in the interior and that the above described mercury lamp in the range of $1<(W\times G/V)$ can be subjected to light control, V ($cm^3$) is the inside volume of the concave reflector, W is the rated power of the mercury lamp and G is the wall load.

As was described above, according to the invention, the concave reflector and the mercury lamp are cooled by means of a cooling means with an intensity which can be changed, and moreover, the cooling intensity thereof is carried out together with the light control of the mercury lamp. In this light control, it is specifically a matter of the fact that the power of the lamp can be changed. It was thus found that, for a small lamp unit which is used for a projector, both the above described cooling and also light control can be advantageously performed when numerical values which are derived in such a way that the inside volume of the concave reflector, the power of the mercury lamp and the wall load of the mercury lamp are taken into account and are considered to be factors which lie within a given range. There is no clear reason for the inside volume of the concave reflector, the power of the mercury lamp and the wall load of the mercury lamp to have been considered to be factors; however, it was found that the cause of the increase of temperature which is to be reduced by cooling depends on these factors.

Moreover, it was found that the above described numerical values in the following cases are in different ranges, specifically in the case in which the concave reflector is hermetically sealed, furthermore in the case in which the concave reflector has an essentially hermetically enclosing arrangement in which the concave reflector is provided partially with openings, and in the case in which in the concave reflector a flow path for the actively flowing cooling air is formed, i.e., the mercury lamp is located in a certain line for the cooling air.

The invention is described below in greater detail with reference to the accompanying drawings.

BRIEF DESCRIPTION OF THE DRAWINGS

FIGS. 5(*a*) & 5(*b*) are tables showing test results representing the action of the invention.

DETAILED DESCRIPTION OF THE INVENTION

Figure 1:
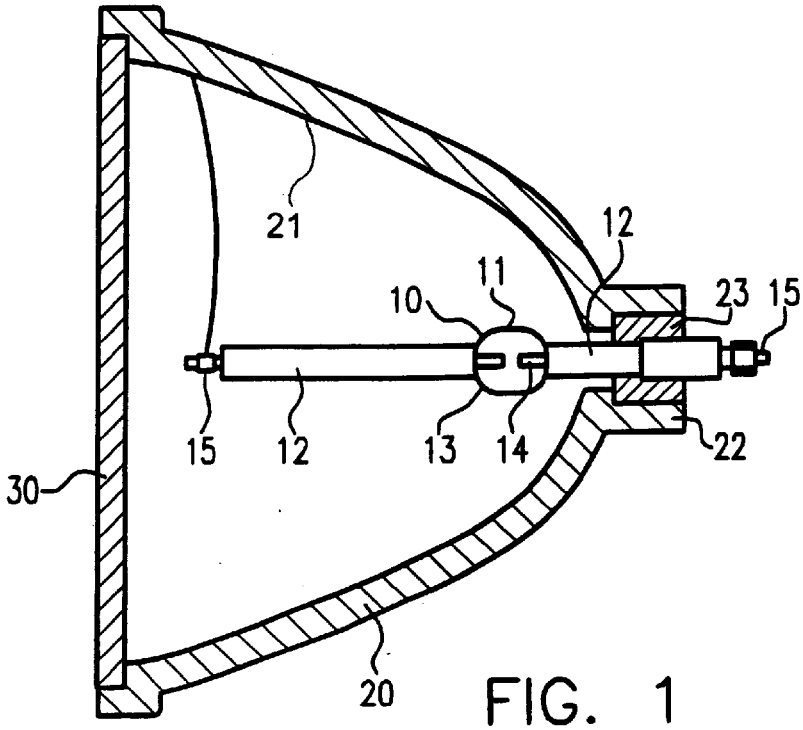
FIG. 1 is a schematic cross-sectional view of a lamp unit in accordance with the invention.

FIG. 1 shows a lamp unit in accordance with the invention which comprises a mercury lamp 10 of the short arc type, a concave reflector 20 and a front cover 30. A discharge vessel 11 of the high pressure mercury lamp 10 is made of quartz glass and is an essentially spherical body. In the discharge vessel 11, there is a pair of electrodes, i.e., an anode 13 and a cathode 14 disposed opposite one another. Furthermore, the discharge vessel 11 is filled with mercury and a rare gas. Hermetically sealed portions 12 are integrally connected to opposite sides of the discharge vessel. The hermetically sealed portions 12 are formed by the quartz glass tube bodies which extend from the ends of the discharge vessel 11 having been melted and by their interior having been exposed to a negative pressure. This means that they were formed by a shrink seal method. Within each hermetically sealed portion 12, a molybdenum foil (not shown in the drawings) is enclosed and electrically connects the electrodes 13, 14 to an outside terminal 15, as is known in the art.

The polarities of the anode 13 and the cathode 14 during luminous operation using a direct current can also be reversed from the state shown in FIG. 1. Furthermore, luminous operation can be carried out using an alternating current. The hermetically sealed portions 12 can also be formed by a pinch seal method in which the quartz glass tube bodies are melted and contracted.

Specific numerical values of the high pressure mercury lamp of the short arc type 10 are given below as an example:

- The amount of mercury added is 0.20 $mg/mm^3$.
- As the rare gas, argon gas with a pressure of 10 kPa is added.
- The distance between the electrodes is 1.5 mm.
- The inside volume of the discharge vessel 11 is 120 $mm^3$.
- The rated voltage is 82 V.
- The rated power consumption is 200 W.

The numerical values are of course not limited to the aforementioned values of the above examples.

However, it is necessary to add at least 0.15 $mg/mm^3$ mercury in order to use the high pressure mercury lamp of the short arc type 10 as a light source lamp for a liquid crystal projector device. The reason for this is to suppress broadening of the arc by increasing the mercury vapor pressure, to increase the light intensity, and thus, to obtain a light source which is suitable for the projection device.

The concave reflector 20 is made of glass, for example, borosilicate glass, and the inside diameter of the front opening thereof is roughly 120 mm. The reflection surface 21 of the concave reflector 20 is a curved surface of rotation and a film is formed on its surface by vapor deposition of titanium oxide-silicon oxide (titania-silica) which provides an outstanding reflection characteristic. In the upper part of the concave reflector 20, a holding cylinder 22 is formed into which one of the hermetically sealed portions 12 of the mercury lamp 10 is inserted. The axis of the mercury lamp 10 coincides with the optical axis of the concave reflector 20. Moreover, the mercury lamp 10 is in a state in which the arc radiance spot formed during luminous operation between the electrodes 13, 14 is located at the first focal spot of the concave reflector 20 and is attached in the concave reflector 20 by means of an adhesive 23 which has been added to the holding cylinder 22.

The front opening of the concave reflector 20 is covered by a translucent front cover 30 which is made, for example, of borosilicate glass so that the fragments of the high pressure mercury lamp 10 do not spray out of the front opening when the lamp 10 breaks in the worst case.

By the arrangement of the front glass in the essentially concave reflectors in the described manner, the interior of the concave reflector 20 acquires a hermetically enclosing arrangement by which the interior is spatially separated from the exterior.

Figure 2:
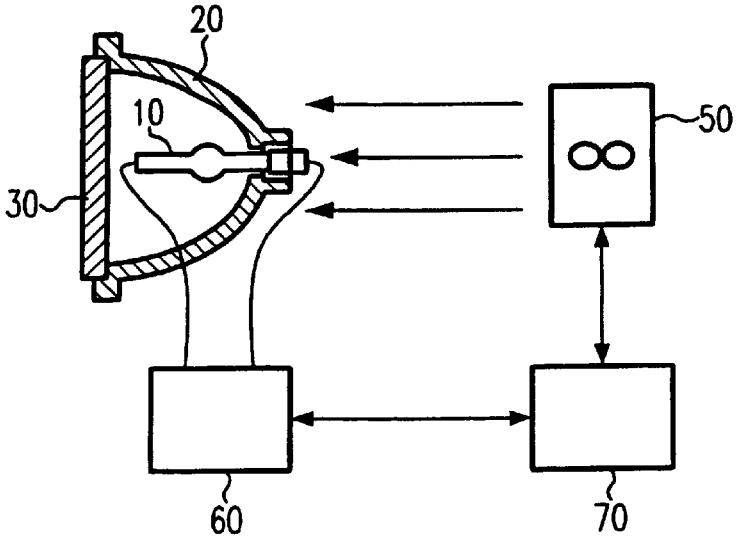
FIG. 2 shows a schematic depiction of a lamp unit in accordance with the invention.

FIG. 2 shows the lamp unit of FIG. 1 together with a cooling means 50 for it, a means 60 for changing the power of the mercury lamp, and a light control means 70. The cooling means 50 comprises, for example, an axial fan and advantageously cools the lamp unit, for example, the outside surface of the concave reflection part of the concave reflector 20. The means 60 for changing the power in the mercury lamp is a so-called current source for luminous operation of the mercury lamp. By supplying a given power, the means 60 advantageously operates the lamp. More specifically, this means 60 has a starter by which a high voltage pulse of a few kV is applied when luminous operation starts, and thus, luminous operation of the mercury lamp is initiated. Afterwards, power (current, voltage), which is dictated by the lamp characteristics, is supplied to the mercury lamp.

The light control means 70 increases the starting power for the lamp when the lamp is to be made brighter, and together with it, increases the power (intensity) of the cooling means. If, on the other hand, the brightness of the lamp is to be reduced, the light control means 70 reduces the starting power for the lamp, and together with it, also reduces the power of the cooling means. This concomitant control can be achieved by a controller, which is located in the light control means 70, being adjusted by signals being sent to the cooling means 50 and the means 60 for changing the lamp power. Conceptually, there is indeed such a described arrangement. As a physical arrangement in reality, however, if necessary, an arrangement in which the means 60 for changing the lamp power and the light control means 70 are located jointly in a single box or similar arrangements are used.

Another lamp unit is described below using a specific example.

Figure 3:
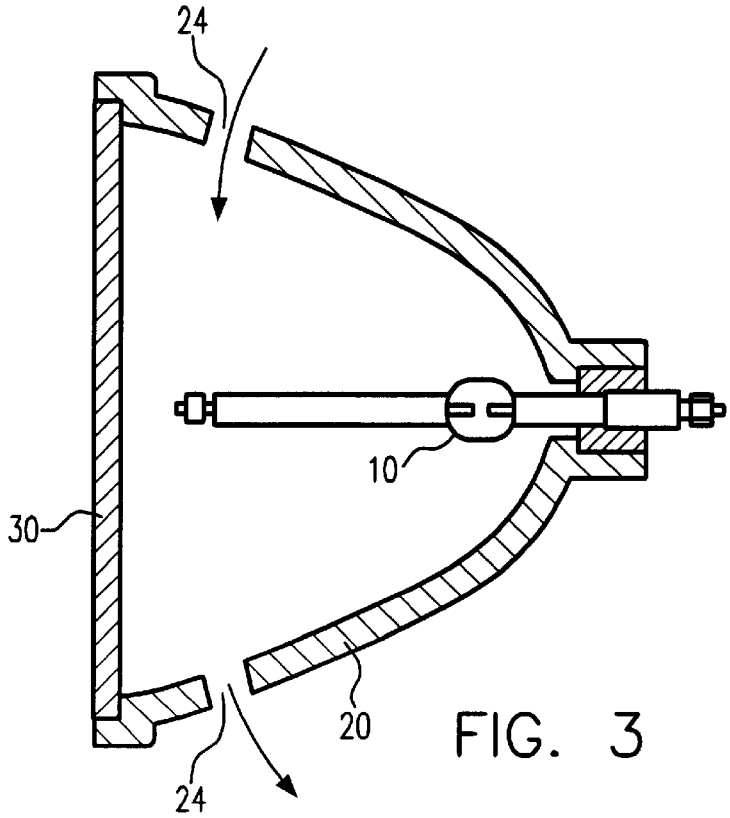
FIG. 3 is a schematic cross-sectional view of a lamp unit with a modified reflector in accordance with the invention.

FIG. 3 shows a lamp unit with an essentially hermetically enclosing shape in which the concave reflector 20 is partially provided with openings. Therefore, there is no completely hermetically enclosed arrangement here.

Compared to the lamp unit as shown in FIG. 1, in the lamp unit as shown in FIG. 3, the concave reflection part of the concave reflector 20 has openings 24 which intake or release cooling air. The following can be stated about the relationship between the cooling air and these openings 24. Outside of the openings 24 there can be a means which forcefully blows in or intakes cooling air. Or the cooling air can be taken in naturally only through the arrangement of the openings without such a cooling means. However, the lamp unit, in this arrangement, has the feature that, within the reflector described below, instead of an arrangement in which a flow path is formed which actively moves the cooling air, there are only openings in the concave reflector. This means that there are an intake opening and a discharge opening here for the cooling air, but there is no specific flow path. In the arrangement shown in FIG. 3, the feed line for the lamp is not shown.

Another example of a lamp unit is specifically described below.

Figure 4:
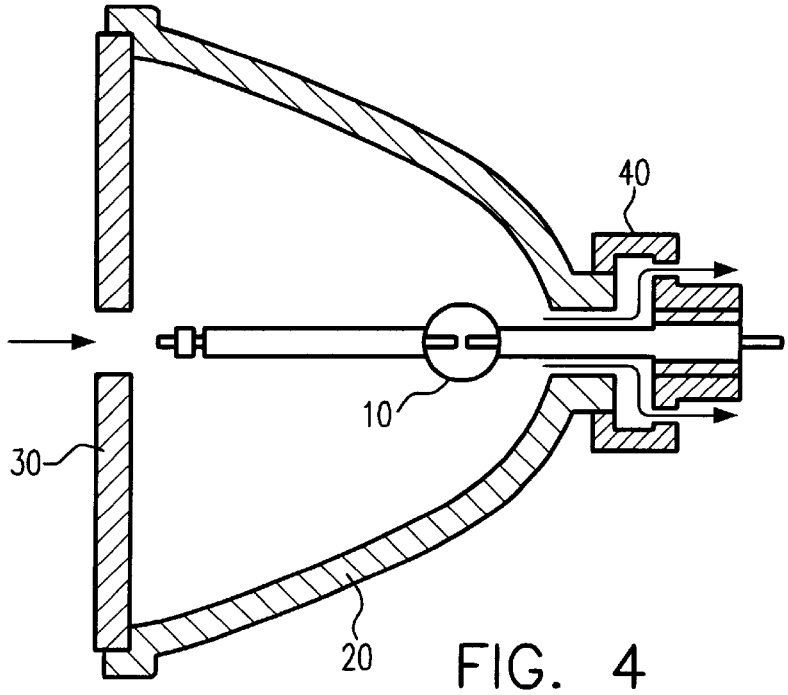
FIG. 4 is a schematic cross-sectional view of a lamp unit with a modified front glass in accordance with the invention.

FIG. 4 shows an arrangement with the feature that the concave reflector (including the front glass) is provided with an intake opening and a discharge opening for the cooling air, and a flow path is formed via which cooling air flows from one of the ends of the mercury lamp to the other end, and thus, the mercury lamp is essentially cooled overall. The arrangement in FIG. 4 differs in this respect from the arrangements shown in FIGS. 1 & 3.

In this arrangement, for example, there is a concave reflector 20 in a differential pressure guide path. This means that outside of the concave reflector a flow path is formed for the cooling air with a certain direction. An arrangement can be obtained in which the cooling air is delivered to the concave reflector by the pressure difference between inside and outside of the concave reflector 20.

In the figure, in the middle of the front glass 30, there is an intake opening. A base 40 is located in the upper part of the concave reflector 20 and is provided with air discharge openings. Also, outside of the concave reflector, as is shown in the drawings, flow of the cooling air takes place as represented by the arrows in FIG. 4, i.e., a differential pressure guide path is formed so that an arrangement results in which cooling air also flows into the interior of the concave reflector naturally.

Furthermore, it is necessary for there to be an arrangement in which, within the concave reflector, cooling air flows from one of the ends of the lamp to the other end. The position at which the cooling air is taken into the concave reflector need not be in the front glass, but can be, for example, in part of the concave reflector.

The invention is further described below using tests.

Tests were run which used the lamp unit shown in FIG. 1 with a completely hermetically enclosing arrangement, the lamp unit shown in FIG. 3 with an essentially hermetically enclosing arrangement, in which the concave reflector is provided partially with openings, and the lamp unit shown in FIG. 4 in which a flow of cooling air is formed from one of the ends of the mercury lamp in the direction to the other end.

In the mercury lamp:

the outside diameter of the emission part was 11.5 mm, the thickness was 3 mm, the inside surface of the emission part was roughly 120 $mm^2$, the distance between the electrodes was 1.3 mm and the amount of mercury added was 170 $mg/cm^3$ and the mercury lamp was filled with 13 kPa argon gas and roughly 2 micrograms of bromine.

Two types of concave reflectors were used and tests were run with each of the above described three types. Here:

a first test (test 1) was run in which the outside diameter of the concave reflector was 95Φ, the distance between the top part of the reflector and the arc radiance spot was 8 mm and the inside volume was 130 $cm^3$, and in which titanium oxide-silicon oxide (titania-silica) was deposited on borosilicate glass, and a second test (test 2) was run in which the outside diameter of the concave reflector was 70Φ, the distance between the top part of the reflector and the arc radiance spot was 7 mm and the inside volume of the concave reflector was 80 $cm^3$, and in which titanium oxide-silicon oxide (titania-silica) was likewise deposited on borosilicate glass.

In the indicated three types of lamp units, outside the concave reflector, cooling air was allowed to flow, in the range of power of the mercury lamp from 100 to 200 W, a change was made and the luminous situation of the lamp confirmed. A measurement was taken to confirm this luminous situation with respect to the following four points.

As the first evaluation, the state during start-up of luminous operation of the mercury lamp was measured, i.e., whether normal luminous operation of the lamp was started or whether, as a result of a large amount of unvaporized mercury, luminous operation cannot be started. If, during start-up of luminous operation of the mercury lamp, the lamp temperature is not increased enough, unvaporized mercury remains even after starting of luminous operation in a large amount, for which reason advantageous vaporization of the mercury cannot take place. As a result, luminous operation is hindered. The cases in which good luminous operation was started were labeled "o". The cases in which luminous operation was not started were labeled "x".

As a second evaluation, the state of the lamp after 1500 hours of luminous operation was measured, i.e., whether deformation occurred or not in the arc tube. In the case in which cooling does not proceed adequately, as a result of the drop in the viscosity of the arc tube and the inside pressure in the arc tube, swelling occurs. This means specifically the case in which advantageous luminous operation of the mercury lamp cannot be maintained only by changing the intensity of the cooling means.

As a third evaluation, the state of the inside of the concave reflector was measured after 1500 hours of luminous operation. The reason for this is that, in the case of borosilicate glass, generally at a temperature of above 500° C., as a result of thermal distortion in the glass, cracks are formed, and in the worst case, the reflector is damaged. This evaluation relates to cases in which advantageous luminous operation of the mercury lamp cannot be maintained only by changing the intensity of the cooling means.

As the fourth evaluation, the degree to which the screen illuminance after 1500 hours of luminous operation is maintained was measured. Those cases were rated O.K. in which the illuminance after 1500 hours luminous operation was at least equal to 50% of the initial illuminance. The reason for this is that, by increasing the power of the lamp, the lamp current increases, that the electrodes are consumed and that the inside surface of the arc tube is fouled as a result.

Those cases in which all elements were considered "usable" with respect to these four aspects are labeled with the rating "o". In the respective test, the intensity of the cooling means was also suitably changed according to the change of the power. The cases with a rating "x" however mean that from any factor defects originated even if the cooling means was controlled in any way possible.

FIGS. 5(*a*) & 5(*b*) show the test results.

From these results it can be determined that, in the hermetically enclosing arrangement of the lamp unit or in the essentially hermetically enclosing arrangement in which the concave reflector is provided partially with openings, in the case in which the value of K=(W×G/V) is greater than 1 and less than 2, by changing the intensity of the cooling means, the lamp output is controlled and light control of the mercury lamp can be performed.

On the other hand, it becomes apparent that in the arrangement of the lamp unit in which a flow of cooling air is produced inside, in the case in which the value of K=(W×G/V) is greater than 1, by changing the intensity of the cooling means the lamp output is controlled and light control of the mercury lamp can be performed.

Action of the Invention

As was described above, in accordance with the invention, in a lamp unit with an essentially hermetically enclosing arrangement for a projector, which comprises a high pressure mercury lamp of the short arc type with a wall load of at least 1 $W/mm^2$ which is filled with greater than or equal to 0.15 $mg/mm^3$ mercury;

a concave reflector which surrounds this mercury lamp; and a front glass which covers the front opening of this concave reflector, in the range $1<(W\times G/V)<2$, where V ($cm^3$) is the inside volume of the concave reflector, W is the rated power of the mercury lamp and G is the wall load, the cooling intensity of a cooling means, with an intensity which can be changed with respect to the concave reflector and/or the above described mercury lamp, is controlled according to the change of the power of the mercury lamp. By means of this measure, light control of a mercury lamp can be performed while the different properties as a projector device are maintained.

Furthermore, according to the invention, in the case in which the lamp unit has neither a hermetically enclosing arrangement nor an essentially hermetically enclosing arrangement, but an arrangement in which cooling air is obtained from outside, the concave reflector, and moreover, the mercury lamp, is essentially cooled overall, and in which afterwards the cooling air can be discharged to the outside by the above described unit, in the range of $1<(W\times G/V)$, the cooling intensity of a cooling means with an intensity which can be changed with respect to the concave reflector and/or the above described mercury lamp is suitably controlled according to the change of the power of the mercury lamp. Light control of the mercury lamp can be accomplished by this measure.

What I claim is:

1. Lamp unit for a projector, comprising:

a high pressure mercury lamp of the short arc type with a wall load of at least 1 $W/mm^2$ which is filled with at least 0.15 $mg/mm^3$ mercury;

a concave reflector which surrounds said mercury lamp and has a front opening; and a front cover which covers the front opening of this concave reflector;

a cooling means having a controllable cooling intensity for cooling at least one of the concave reflector and the mercury lamp; and a control means for changing the power of the mercury lamp, wherein the cooling means and the control means are constructed for producing a value of W×G/V in a range of $1<W\times G/V$, V in $cm^3$ being an inside volume of the concave reflector, W (in watts) being a rated luminous output of the mercury lamp, and G being the wall load watts/$mm^2$.

2. Lamp unit for a projector as claimed in claim 1, further comprising an arrangement for routing cooling air into the interior of the concave reflector and then to the outside out of the lamp unit to cool the mercury lamp from the outside of the concave reflector.

3. Lamp unit for a projector as claimed in claim 2, wherein the concave reflector has at least one air intake or discharge opening for the cooling air in a part adjacent to the front cover.

4. Lamp unit for a projector as claimed in claim 2, wherein the front cover has an air inlet opening which is located essentially in its center and at least one air discharge opening is provided in an area of the concave reflector which is essentially opposite the air inlet opening.

5. Lamp unit for a projector as claimed in claim 2, which is located in a differential pressure system such that cooling air flows in through an air inlet opening and emerges again through an air outlet opening.

6. Lamp unit for a projector as claimed in claim 4, which is located in a differential pressure system such that cooling air flows in through an air inlet opening, flows essentially along the entire length of the mercury lamp, and emerges again through at least one air outlet opening.

7. Lamp unit for a projector as claimed in claim 1, wherein the cooling means is a fan.

8. Lamp unit for a projector as claimed in claim 1, which has at least an essentially hermetically enclosing arrangement, the cooling means and the control means being constructed for producing said value of $W \times G/V$ in a range of $1 < W \times G/V < 2$.

9. Lamp unit for a projector as claimed in claim 1, further comprising a controller which transfers control signals to the cooling means and the control means for controlling the lamp power in order to enable operation in the range $1 < W \times G/V$.

10. Process for light control of a lamp unit for a projector, wherein the lamp unit comprises:

a high pressure mercury lamp of the short arc type with a wall load of at least 1 watts/mm$^2$ which is filled with at least 0.15 mg/mm$^3$ mercury;

a concave reflector which surrounds said mercury lamp and has a front opening; and a front cover which covers the front opening of this concave reflector;

a cooling means having a controllable cooling intensity for cooling at least one of the concave reflector and the mercury lamp; and a control means for changing the power of the mercury lamp, comprising the step of controlling the cooling means and the control means for producing a value of $W \times G/V$ in a range of $1 < W \times G/V$, V in cm$^3$ being an inside volume of the concave reflector, W (in watts) being a rated luminous output of the mercury lamp, and G being the wall load watts/mm$^2$.

11. Process for light control of a lamp unit for a projector as claimed in claim 10, wherein the lamp unit has at least an essentially hermetically enclosing arrangement, and wherein said controlling step is performed so as to produce a value of $W \times G/V$ in a range of $1 < W \times G/V < 2$.

* * * * *